US010359168B2

(12) United States Patent
Lee et al.

(10) Patent No.: US 10,359,168 B2
(45) Date of Patent: Jul. 23, 2019

(54) BI-FUNCTIONAL HEADLAMP FOR VEHICLE

(71) Applicant: Hyundai Motor Company, Seoul (KR)

(72) Inventors: Seong Hoon Lee, Gyeonggi-do (KR); Young Sub Oh, Gyeonggi-do (KR); Su Ho Bae, Gyeongsangbuk-do (KR)

(73) Assignee: Hyundai Motor Company, Seoul (KR)

( * ) Notice: Subject to any disclaimer, the term of this patent is extended or adjusted under 35 U.S.C. 154(b) by 286 days.

(21) Appl. No.: 15/378,667

(22) Filed: Dec. 14, 2016

(65) Prior Publication Data

US 2017/0299140 A1 Oct. 19, 2017

(30) Foreign Application Priority Data

Apr. 15, 2016 (KR) ..... 10-2016-0046021

(51) Int. Cl.

| | |
|---|---|
| ***F21S 41/689*** | (2018.01) |
| ***F21S 41/255*** | (2018.01) |
| ***F21S 41/47*** | (2018.01) |
| *F21S 41/162* | (2018.01) |
| *F21S 41/32* | (2018.01) |
| *F21W 102/13* | (2018.01) |
| *F21S 41/172* | (2018.01) |

(52) U.S. Cl.

CPC ..... *F21S 41/689* (2018.01); *F21S 41/255* (2018.01); *F21S 41/47* (2018.01); *F21S 41/162* (2018.01); *F21S 41/172* (2018.01); *F21S 41/321* (2018.01); *F21W 2102/13* (2018.01)

(58) Field of Classification Search

CPC .... F21S 41/68–698; F21S 41/40; F21S 41/43; F21S 41/47

USPC ..... 362/539

See application file for complete search history.

(56) References Cited

U.S. PATENT DOCUMENTS

| | | | | |
|---|---|---|---|---|
| 7,455,439 | B2 * | 11/2008 | Albou | F21S 41/695 362/539 |
| 9,945,531 | B2 * | 4/2018 | Lee | F21S 41/285 |
| 2005/0152151 | A1 * | 7/2005 | Lisowski | F21S 41/689 362/513 |
| 2007/0247865 | A1 * | 10/2007 | Kinoshita | F21S 41/17 362/538 |
| 2012/0113663 | A1 * | 5/2012 | Kim | F21S 41/689 362/513 |

FOREIGN PATENT DOCUMENTS

| | | | |
|---|---|---|---|
| KR | 10-2003-0005780 | A | 1/2003 |
| KR | 10-1344429 | B1 | 12/2013 |
| KR | 2014-0133315 | A | 11/2014 |
| KR | 2015-0007071 | A | 1/2015 |
| KR | 2015-0017217 | A | 2/2015 |
| KR | 2015-0060232 | A | 6/2015 |

* cited by examiner

*Primary Examiner* — Julie A Bannan

(74) *Attorney, Agent, or Firm* — Mintz Levin Cohn Ferris Glovsky and Popeo, P.C.; Peter F. Corless

(57) ABSTRACT

A bi-functional headlamp for a vehicle is provided. The bi-functional headlamp implements a high beam mode and a low beam mode by adjusting a movement of a shield of a headlamp. The bi-functional headlamp reduces the occurrence of impact and noise caused by an operation of opening and closing the rotary shield by maintaining contact between a shock absorber component that reduces operational noise of the rotary shield and one side of the rotary shield.

5 Claims, 5 Drawing Sheets

< LOW BEAM MODE >

< HIGH BEAM MODE >

BI-FUNCTIONAL HEADLAMP FOR VEHICLE

CROSS-REFERENCE TO RELATED APPLICATION

This application claims under 35 U.S.C. § 119(a) the benefit of Korean Patent Application No. 10-2016-0046021 filed on Apr. 15, 2016, the entire contents of which are incorporated herein by reference.

BACKGROUND

(a) Technical Field

The present disclosure relates to a bi-functional headlamp for a vehicle and more particularly, to headlamp for a vehicle that implements a high beam mode and a low beam mode by adjusting a movement of a shield of a headlamp.

(b) Background Art

Generally, a vehicle includes lighting devices which have a lighting function that allows a driver to view objects positioned in a traveling direction of the vehicle when the vehicle is driven during low light conditions. A signal function informs drivers of other vehicles or other road users of a driving state of the vehicle. Among the lighting devices for a vehicle, headlamps, (e.g., headlights) are typically mounted at two sides in front of the vehicle and illuminate a path in front of the vehicle during operation of the vehicle at low light conditions. Thus, a driver's visibility is improved in a traveling direction. The headlamp should not obstruct (e.g., cause light blindness of a driver) the view of a driver in an oncoming vehicle. Accordingly, an operation mode of the headlamp is adjusted to a low beam mode or a high beam mode the driver manipulation.

Recently, to adjust and selectively use the low and high beam modes, a bi-functional headlamp has been applied. For example, a shield driving device (or light distribution direction changing device) includes a rotary shield, that emits a high beam and a low beam using a single light source. The bi-functional headlamp emits the high beam or the low beam by adjusting light reflected by a reflector by using the shield driving device.

In particular, the shield driving device adjusts a rotational position of the shield by an actuator. The actuator directs the light downward by an operation that closes the shield (e.g., low beam mode), or directs the light both upward and downward by an operation of opening the shield (e.g., high beam mode). The bi-functional headlamp does not produce a substantial amount of noise when the shield is rotated to an open position by the actuator. However, when electric power applied to the actuator is shut off and the shield is rotated to a closed position by restoring force of a return spring, the shield collides with a damper and produces noise.

The above information disclosed in this section is merely for enhancement of understanding of the background of the invention and therefore it may contain information that does not form the prior art that is already known in this country to a person of ordinary skill in the art.

SUMMARY

The present invention provides a bi-functional headlamp for a vehicle that reduces the impact and noise caused by of opening and closing a rotary shield by maintaining a contact state between a shock absorber that reduces operational noise of the rotary shield and one side of the rotary shield.

In one aspect, the present invention provides a bi-functional headlamp for a vehicle that may include: a rotary shield disposed at a front side of a light source, and configured to rotate about a rotating shaft to perform a closing operation to obstruct a portion of light entering an aspherical lens from the light source or an opening operation that removes the obstruction of the light, an actuator configured to provide rotational power to the rotary shield, a position restricting cam mounted on the rotating shaft and configured to be simultaneously rotated with the rotating shaft, a shock absorber that maintains a contact state with the position restricting cam and reduces impact caused by the rotation of the rotary shield and a return spring disposed on the rotating shaft of the rotary shield and configured to generate an elastic restoring force while being deformed when the rotary shield is opened.

In an exemplary embodiment, the shock absorber may include a cam contact portion configured to move in a linear trajectory (e.g., straight line) in conjunction with the rotation of the position restricting cam and may maintain contact with the position restricting cam. A shock absorbing spring may be configured to elastically support the cam contact portion to enable the cam contact portion to move in a linear trajectory. An end portion of the cam contact portion may maintain contact with the position restricting cam and may be provided with a curved center contact portion which comes into line contact with the position restricting cam and side contact portions that may be formed at both sides of the center contact portion and may be in surface contact with the position restricting cam.

In another exemplary embodiment, a contact surface, may maintain contact with the cam contact portion and may be disposed on an exterior circumferential surface of the position restricting cam. The contact surface may include a line contact section that may be in line contact with the cam contact portion. A surface contact sections may be formed at both sides of the line contact section and may be in surface contact with the cam contact portion.

In another exemplary embodiment, a shield closing catching projection may be disposed at an end portion of a first surface contact sections disposed at both sides of the line contact section of the position restricting cam to enable the rotary shield to be stopped when the rotary shield is disposed in a closed position. In addition, a shield opening catching projection may be disposed at an end portion of the second surface contact section to enable the rotary shield to be stopped when the rotary shield is disposed in an open position.

The actuator may include a motor configured to generate rotational power for the rotary shield, a shield pulley configured to be simultaneously rotated with the rotating shaft of the rotary shield, a motor pulley configured to be rotated by power of the motor and a power transmission member coupled to the shield pulley and the motor pulley to be rotated simultaneously with the shield pulley and the motor pulley and transmits power of the motor to the rotary shield.

According to the bi-functional headlamp for a vehicle according to the present invention, when the rotary shield rotates to adjust between the closed and opened positions when the position is completely changed, the contact between the position restricting cam and the cam contact portion may be maintained. In particular, the amount of impact caused by the rotation of the rotary shield may be reduced and the operational noise caused by the operation of opening and closing the rotary shield may be reduced.

BRIEF DESCRIPTION OF THE DRAWINGS

The above and other features of the present invention will now be described in detail with reference to exemplary embodiments thereof illustrated in the accompanying drawings which are given hereinbelow by way of illustration only, and thus are not limitative of the present invention, and wherein.

Figure 1:
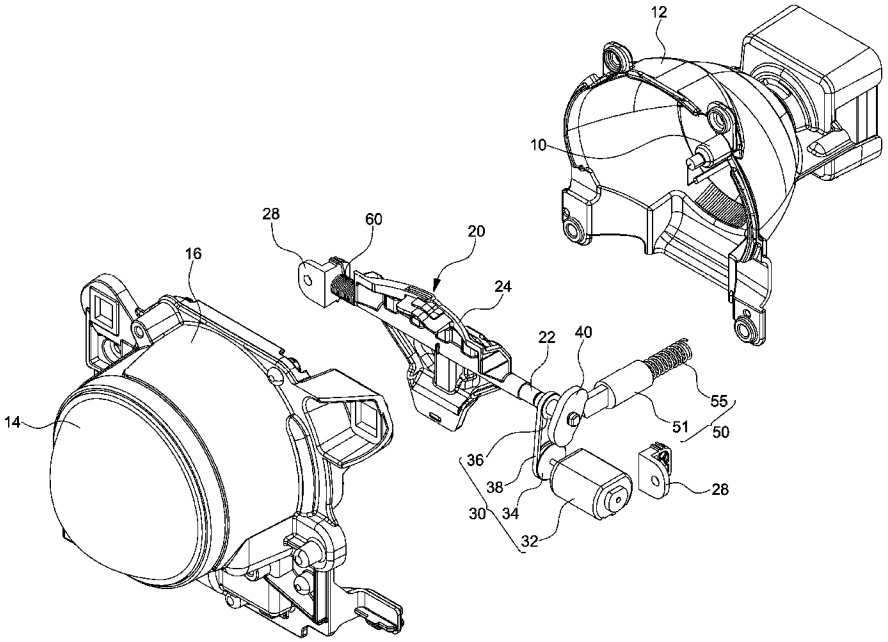
FIG. 1 is an exemplary exploded perspective view illustrating a bi-functional headlamp according to an exemplary embodiment of the present invention.

Reference numerals set forth in the Drawings includes reference to the following elements as further discussed below:

10: light source
12: reflector
14: aspherical lens
16: lens holder
20: rotary shield
22: rotating shaft
24: shield wing
28: mounting bracket
30: actuator
32: motor
34: motor pulley
36: shield pulley
38: power transmission member
40: position restricting cam
41: contact surface
42: first surface contact section
43: second surface contact section
44: line contact section
45: shield closing catching projection
46: shield opening catching projection
50: shock absorber
51: cam contact portion
52: first side contact portion
53: second side contact portion
54: center contact portion
55: shock absorbing spring
60: return spring It should be understood that the appended drawings are not necessarily to scale, presenting a somewhat simplified representation of various exemplary features illustrative of the basic principles of the invention. The specific design features of the present invention as disclosed herein, including, for example, specific dimensions, orientations, locations, and shapes will be determined in part by the particular intended application and use environment. In the figures, reference numbers refer to the same or equivalent parts of the present invention throughout the several figures of the drawing.

DETAILED DESCRIPTION

Hereinafter reference will now be made in detail to various exemplary embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other exemplary embodiments, which may be included within the spirit and scope of the invention as defined by the appended claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

Figure 2A:
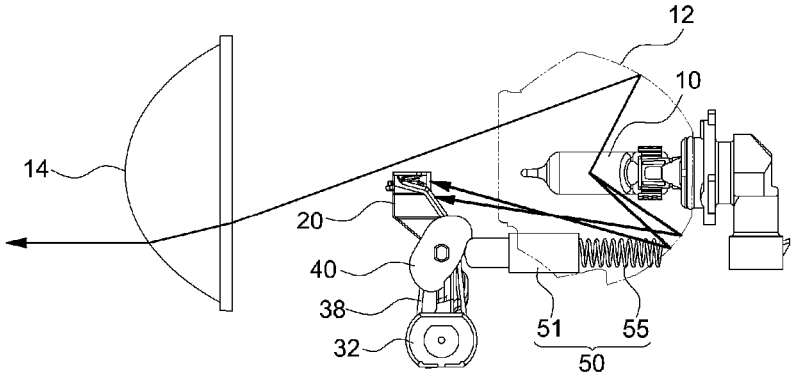
FIGS. 2A and 2B are exemplary side views illustrating an operation of the bi-functional headlamp according to the exemplary embodiment of the present invention.
Figure 2B:
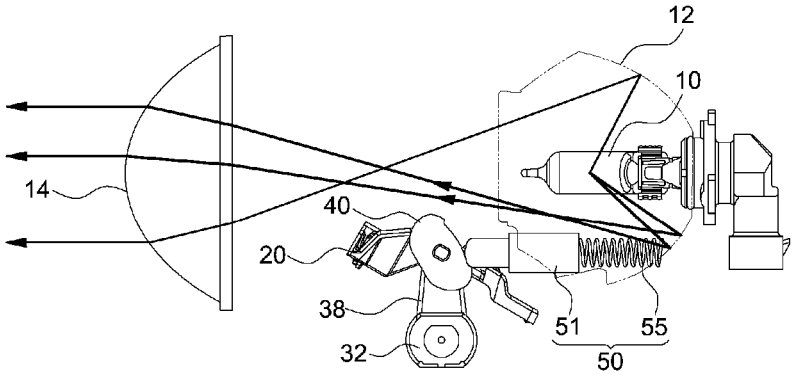

Hereinafter, an exemplary embodiment of the present invention will be described in detail with reference to the accompanying drawings. As illustrated in FIGS. 1, 2A and 2B, a bi-functional headlamp according to the present invention may include a light source 10 configured to emit light, a reflector 12 configured to reflect the light emitted from the light source 10, and an aspherical lens 14 which allows the light emitted and reflected by the reflector 12 to be formed in a linear trajectory (e.g., straight line) and discharged to the exterior. A rotary shield 20 may be configured to rotate to block or unblock a portion of the light (e.g., light directed upward) that enters the aspherical lens 14 and a lens holder 16 which fixedly supports the aspherical lens 14 at a front side of the light source 10.

The headlamp may include a shield driving device configured to rotate the rotary shield 20 at a predetermined angle to selectively obstruct a portion of the light of the light source 10 that enters the aspherical lens 14. The shield driving device may include an actuator 30 configured to generate rotational power to open the rotary shield 20 and a return spring 60 configured to generate an elastic restoring force to return the rotary shield 20 rotated by the actuator 30. A position restricting cam 40 may restricts) a rotational position of the rotary shield 20 when the rotary shield 20 is opened and closed. A shock absorber 50 may be configured to reduce an operational impact attributed to an operation that adjusts the rotary shield 20 to an open or closed position.

The rotary shield 20 may be disposed in front of the light source 10. For example, the rotary shield may be installed and mounted by penetration of a rear end portion of the reflector 12. The rotary shield 20 may be positioned at a rear side of the aspherical lens 14 and may be configured to rotate about a rotating shaft 22. The rotating shaft may be rotatably supported by mounting brackets 28 coupled to the rear ends of the lens holder 16 or the front ends of the reflector 12.

Based on a rotation angle of the rotary shield 20, the rotary shield 20 may be disposed in a closed position when a portion of the light that enters the aspherical lens 14 from the light source 10 is obstructed (e.g., blocked) Alternatively, the rotary shield 20 may be disposed in an opened position when the light is not blocked. Specifically, the rotary shield 20 may include a shield wing 24 positioned at a central portion in a longitudinal direction of the rotating shaft 22 that extends in a linear trajectory. The shield wing 24 may be configured to simultaneously rotate with the rotating shaft 22. Additionally, the shield wing 24 may be configured to rotate about the rotating shaft 22, to a closed position to obstruct light by the shield wing 24. When the shield wing 24 is disposed in an open position, the light may pass unobstructed.

The power of the actuator 30 may be used to rotate the rotary shield 20 from a closed position to an opened position to allow light to enter an upper portion of the aspherical lens 14. The actuator 30 may include a motor 32 configured to generate rotational power for the rotary shield 20, a motor pulley 34 coupled to a rotating shaft of the motor 32 and configured to simultaneously rotate with the rotating shaft by power from the motor, a shield pulley 36 coupled to the rotating shaft 22 of the rotary shield 20 and may be configured to simultaneously rotate with the rotating shaft 22 and a power transmission member 38 coupled to the motor pulley 34 and the shield pulley 36 and may be configured to be simultaneously rotated with the motor pulley 34 and the shield pulley 36 and may be configured to transmit rotational power of the motor 32 to the rotary shield 20.

The power transmission member 38 may be formed of a material that may generate a predetermined or higher level of surface frictional force and may have a continuous loop shape (e.g., or the like). The power transmission member 38 may be installed to simultaneously rotate with the shield pulley 36 and the motor pulley 34 through frictional contact and may be configured to transmit power of the motor 32 to the rotary shield 20. Further, to return the rotary shield 20 that has been rotated to the opened position by the actuator 30, a return spring 60 may be mounted on the rotating shaft 22 of the rotary shield 20.

The return spring 60 may be configured to generate an elastic restoring force while being compressively deformed when the rotary shield 20 is rotated from the closed position to block light to the opened position to allow the light to pass. In particular, the return spring 60 may be disposed between the rotating shaft 22 of the rotary shield 20 and the mounting bracket 28. For example, when the actuator 30 terminate the power supply, the return spring 60 returns the rotary shield 20 to the closed position using elastic restoring force.

Furthermore, the return spring 60 may be installed at a first end portion of both end portions of the rotating shaft 22 of the rotary shield 20. The position restricting cam 40 may be installed at a second end portion of the rotating shaft 22. The position restricting cam 40 may be configured to restrict the opened and closed positions of the rotary shield 20 adjusted by the actuator 30 and the return spring 60. The position restricting cam 40 may be mounted at an end portion of the rotating shaft 22 and may be configured to be simultaneously rotated with the rotating shaft 22 and disposed adjacent to the shock absorber 50.

In particular, the position restricting cam 40 may include a structure with an approximate elliptical longitudinal cross section (e.g., or similar shape) and may have a contact surface 41 formed at a partial section of an exterior circumferential surface of the position restricting cam 40 and may contact the shock absorber 50 by operation of opening and closing the rotary shield 20. The contact surface 41 may include a portion that maintains contact with the shock absorber 50 (e.g., in contact with a cam contact portion that includes the shock absorber 50), and maintains contact with the cam contact portion 51 regardless of a rotational position of the rotary shield 20 to elastically support the position restricting cam 40 by the shock absorber 50.

Figure 3:
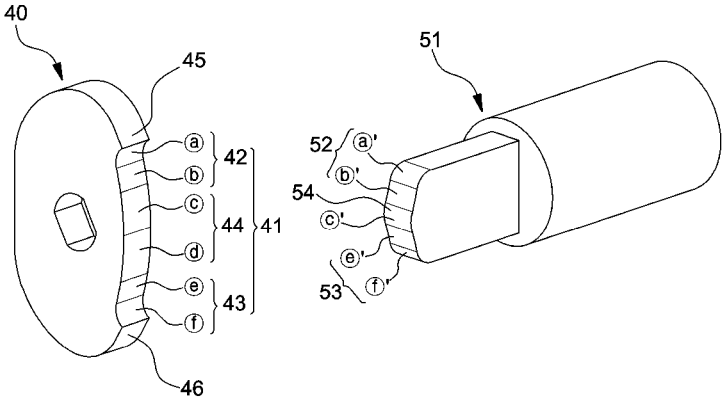
FIG. 3 is an exemplary view illustrating a contact surface of a position restricting cam and a cam contact portion of a shock absorber according to the exemplary embodiment of the present invention.

As illustrated in FIG. 3, based on a contact form with the cam contact portion 51, the contact surface 41 may be divided into a line contact section 44 and surface contact sections 42 and 43. Specifically, the contact surface 41 may include the line contact section 44 at a center thereof and the surface contact sections 42 and 43 disposed at both sides of the line contact section 44. For example, one of the surface contact sections 42 and 43 (i.e., the first surface contact section 42) is a section that the cam contact portion 51 may surface contact when the rotary shield 20 rotates and reaches the closed position and includes a curved section a and a flat section b, and the other surface contact section (i.e., the second surface contact section 43) may include a section that the cam contact portion 51 may surface contact when the rotary shield 20 rotates and reaches the opened position, and may include a flat section e and a curved section f. The first and second surface contact sections 42 and 43 may have a symmetrical structure and thus the sections a and f may have a similar curvature.

The line contact section 44 may be a section that the cam contact portion 51 contacts when an operation mode of the rotary shield 20 is adjusted. In other words, the line contact section 44 may be a section that the cam contact portion 51 line contacts when the rotary shield 20 rotates between the closed position and the opened position and may include two curved sections c and d that may have a similar curvature and the sections c and d may be symmetrical with respect to each other.

The position restricting cam 40 may include the curved sections a and f at end portions of the first and second surface contact sections 42 and 43. Further, the position restricting cam 40 may include a shield closing catching projection 45 and a shield opening catching projection 46 that may be configured to stop the rotary shield 20 that rotates to the opened position or the closed position at an exact position and may be configured to maintain the stopped state of the rotary shield 20.

Figure 4:
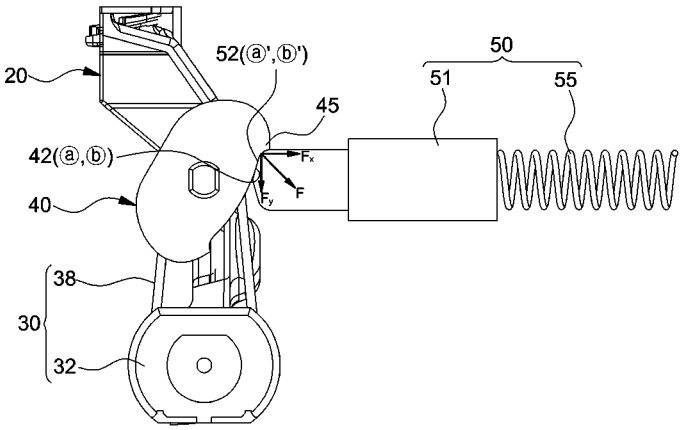
FIG. 4 is a view illustrating a rotary shield of the bi-functional headlamp having the position restricting cam and the shock absorber disposed in a closed position according to the exemplary embodiment of the present invention.

The shield closing catching projection 45 may be disposed at an end portion of the first surface contact section 42 that the cam contact portion 51 may surface contact when the rotary shield 20 is in the closed state. As illustrated in FIGS. 3 and 4, when the rotary shield 20 rotates to the closed position by elastic restoring force of the return spring 60, the position restricting cam 40 may be configured to apply a force (e.g., press) to the cam contact portion 51 when the first surface contact section 42 is in surface contact with the cam contact portion 51. In particular, a reaction force may be generated by a guide (not illustrated) that supports the cam contact portion 51. The rotary shield 20 may remain at a fixed position at the closed position by the reaction force.

Figure 6:
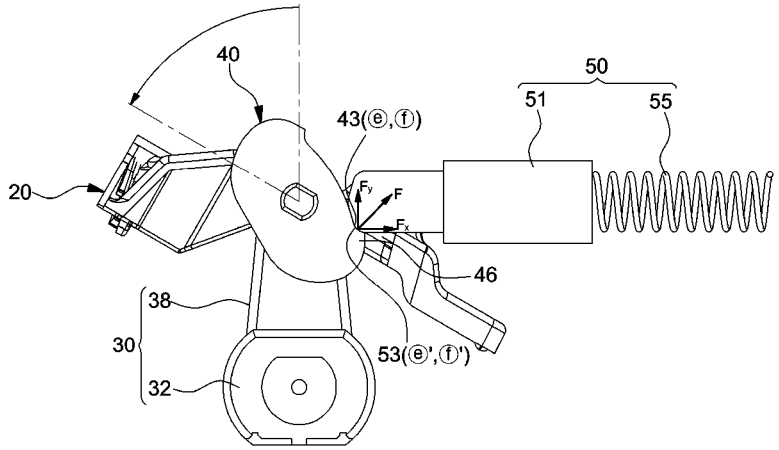
FIG. 6 is a view illustrating the rotary shield of the bi-functional headlamp having the position restricting cam and the shock absorber disposed in an opened position according to the exemplary embodiment of the present invention.

The shield opening catching projection 46 may be disposed at an end portion of the second surface contact section 43 that the cam contact portion 51 may surface contact when the rotary shield 20 is in the opened position. As illustrated in FIGS. 3 and 6, when the rotary shield 20 rotates to the opened position by power of the actuator 30, the position restricting cam 40 may apply a force (e.g., presses) to the cam contact portion 51 when the second surface contact section 43 is in surface contact with the cam contact portion 51. Thus reaction force may be generated by the guide (not illustrated) that supports the cam contact portion 51 and the rotary shield 20 may remain fixed at the opened position by the reaction force. In particular, the actuator 30 may be configured to terminate the operation at substantially the same time when the rotary shield 20 reaches the opened position. As described above, the shield closing catching projection 45 and the shield opening catching projection 46 of the position restricting cam 40 may be configured to restrict a position of the rotary shield 20. In particular, the rotary shield 20 may be disposed in a fixed position (e.g., stopped in place) when the rotary shield 20 is opened and closed.

The shock absorber 50 having the cam contact portion 51 may be provided to maintain contact with the position restricting cam 40 and may reduce impact and noise caused by the rotation of the rotary shield 20. The shock absorber 50 may include the cam contact portion 51 and a shock absorbing spring 55 that may elastically support the cam contact portion 51 to move the cam contact portion 51 in a linear trajectory. When the rotary shield 20 is rotated and stopped, the cam contact portion 51 may maintain contact with the position restricting cam 40 and may be adjusted in a linear trajectory (e.g., in a straight line) in conjunction with the rotation of the position restricting cam 40. Although not illustrated, the bi-functional headlamp according to the present invention may include a guide (not illustrated) configured to guide the straight movement of the shock absorber 50. The shock absorber 50 may be operably supported by the reflector 12 or a vehicle body via the guide.

Referring to FIG. 3, an end portion of the cam contact portion 51, that comes into contact with the contact surface 41 of the position restricting cam 40 may include a curved center contact portion 54 and side contact portions 52 and 53 formed at both sides of the center contact portion 54. The center contact portion 54 may include a curved section (see c' in FIG. 3) in line contact with the line contact section 44 of the position restricting cam 40 when the rotary shield 20 rotates from the closed position to the opened position or rotates from the opened position to the closed position. The side contact portions 52 and 53 may be in surface contact with the surface contact sections 42 and 43 of the position restricting cam 40 when the rotary shield 20 maintains a fixed position in the closed position or the opened position.

In particular, one side contact portion (i.e., the first side contact portion) 52 of the side contact portions 52 and 53 formed at both sides of the center contact portion 54 may be in surface contact with the first surface contact section 42 of the position restricting cam 40 when the rotary shield 20 is in the closed position. The other side contact portion (i.e., the second side contact portion) 53 may be in surface contact with the second surface contact section 43 of the position restricting cam 40 when the rotary shield 20 is in the opened position.

As illustrated in FIG. 3, the first side contact portion 52 may include a curved section a' that may be in surface contact with the section a of the first surface contact section 42 and a flat section b' that may be in surface contact with the section b of the first surface contact section 42. The second side contact portion 53 may include a flat section e' that may be in surface contact with the section e of the second surface contact section 43 and a curved section f' that may be in surface contact with the section f of the second surface contact section 43. The shock absorbing spring 55 may include a first end portion coupled to the cam contact portion 51 and a second end portion coupled to and supported by the vehicle body or coupled to the reflector 12 by a separate support member (not illustrated) to elastically support the cam contact portion 51 to adjust the cam contact portion 51 in a linear trajectory.

Referring to FIGS. 3 to 6, operations of the position restricting cam 40 and the shock absorber 50 in accordance with the operation of opening and closing the rotary shield 20 to implement a low beam mode and a high beam mode of the bi-functional headlamp configured as described above will be described.

First, as illustrated in FIG. 4, when the rotary shield 20 reaches the closed position by elastic restoring force of the return spring 60 and is in the closed position (e.g., the upper drawing in FIG. 2A), the operation of the actuator 30 may be stopped. Further, a rotational force F may be applied to the position restricting cam 40 by an elastic restoring force. In particular, a lateral force Fx of the rotational force F, which compresses the shock absorbing spring may be canceled out by spring force of the shock absorbing spring. The longitudinal force Fy of the rotational force F may be canceled out by a reaction force generated by the guide (not illustrated) of the cam contact portion 51 to stop the rotary shield 20 and maintain the closed position. For example, the first surface contact section 42 of the position restricting cam 40 may be in surface contact with the first side contact portion 52 of the cam contact portion 51.

Figure 5A:
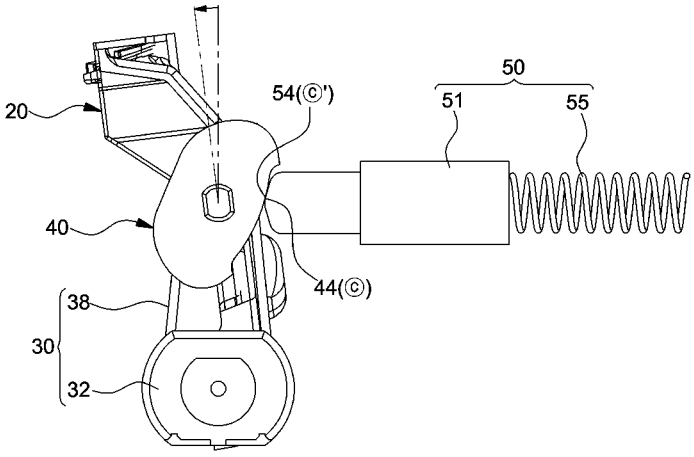
FIGS. 5A to 5C are views illustrating the rotary shield of the bi-functional headlamp having the position restricting cam and the shock absorber are operated in a stepwise manner adjusted from a closed position to an open position according to the exemplary embodiment of the present invention.
Figure 5B:
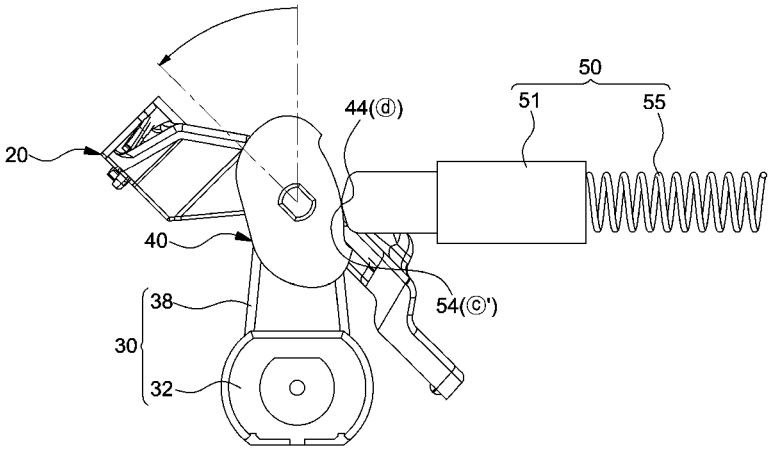
Figure 5C:
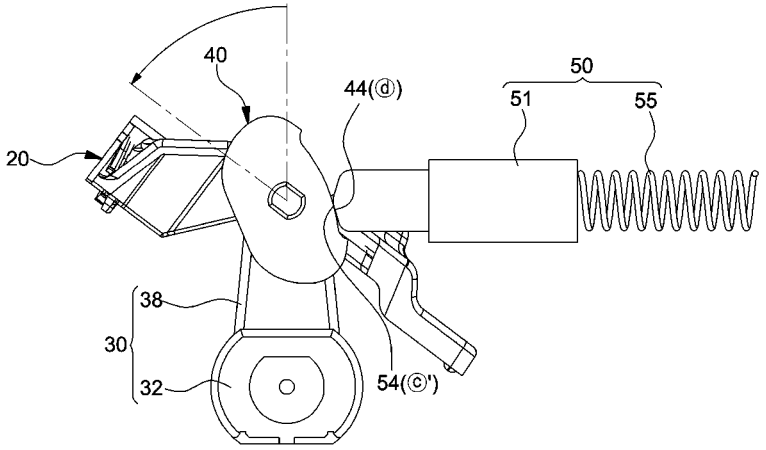

As illustrated in FIGS. 5A to 5C, when the rotary shield 20 is adjusted from the closed position to the opened position by the actuator 30 configured to generate driving power greater than the elastic restoring force of the return spring 60, the surface contact between the position restricting cam 40 and the cam contact portion 51 may be adjusted to be in line contact. Specifically, when the rotary shield 20 begins to rotate to the opened position as illustrated in FIG. 5A, the center contact portion 54 of the cam contact portion 51 begins to come into line contact with the section c of the line contact section 44 of the position restricting cam 40 while the first side contact portion 52 may be separated from the first surface contact section 42. As the rotary shield 20 continues to rotate to the opened position, the center contact portion 54 may be adjusted into line contact with the section d after passing over the section c of the line contact section 44 as illustrated in FIGS. 5B and 5C.

As illustrated in FIG. 6, when the rotary shield 20 reaches the opened position, the second side contact portion 53 of the cam contact portion 51 may be adjusted into surface contact with the second surface contact section 43 of the position restricting cam 40. When the rotary shield 20 reaches the opened position (e.g., the lower drawing in FIG. 2B) as described above, the lateral force Fx, which compresses the shock absorbing spring 55, of the rotational force F applied to the position restricting cam 40 by driving power of the actuator 30 may be canceled out by spring force of the shock absorbing spring 55. The longitudinal force Fy of the rotational force F may be canceled out by reaction force generated by the guide means (not illustrated) of the cam contact portion 51 to fix the position of the rotary shield 20 and maintain the opened position.

When the rotary shield 20 rotates to adjust the state and even when the position is adjusted between the in the closed and opened positions when the state is completely changed, the contact state between the position restricting cam 40 and the cam contact portion 51 may be maintained. Namely, the amount of impact attributed to the rotation of the rotary shield 20 may be significantly reduced and thus operational noise caused by the operation of opening and closing the rotary shield 20 may be reduced by the shock absorber.

The invention has been described in detail with reference to exemplary embodiments thereof. However, it will be appreciated by those skilled in the art that changes may be made in these exemplary embodiments without departing from the principles and spirit of the invention, the scope of which is defined in the appended claims and their equivalents.

What is claimed is:

1. A bi-functional headlamp for a vehicle, comprising:

a rotary shield disposed at a front side of a light source and configured to rotate about a rotating shaft to position the rotary shield in a closed position to obstruct a portion of light entering an aspherical lens from the light source and configured to dispose the rotary shield in an open position to remove the obstruction of the light;

an actuator configured to provide rotational power to the rotary shield;

a position restricting cam mounted on the rotating shaft and configured to be simultaneously rotated with the rotating shaft; and a shock absorber component that maintains contact with the position restricting cam and reduces impact caused by the rotation of the rotary shield, wherein the shock absorber component includes:

a cam contact portion that maintains contact with the position restricting cam that is configured to move in a linear trajectory in conjunction with the rotation of the position restricting cam; and a shock absorbing spring configured to elastically support the cam contact portion to move the cam contact portion in a linear trajectory, and wherein an end portion of the cam contact portion, that maintains contact with the position restricting cam, includes a curved center contact portion and is in line contact with the position restricting cam, and side contact portions formed at both sides of the center contact portion and in surface contact with the position restricting cam.

2. The bi-functional headlamp of claim 1, wherein a return spring is disposed on the rotating shaft of the rotary shield and is configured to generate an elastic restoring force while being deformed when the rotary shield is disposed in the opened position.

3. The bi-functional headlamp of claim 1, wherein a contact surface, configured to maintain contact with the cam contact portion, is provided on an exterior circumferential surface of the position restricting cam, and the contact surface includes a line contact section configured to have line contact with the cam contact portion, and surface contact sections formed at both sides of the line contact section and has surface contact with the cam contact portion.

4. The bi-functional headlamp of claim 3, wherein a shield closing catching projection is disposed at an end portion of a first surface contact section provided at both sides of the line contact section of the position restricting cam and configured to stop the rotation of the rotary shield when the rotary shield is disposed in the closed position, and a shield opening catching projection is disposed at an end portion of a second surface contact section to stop the rotary shield is stopped in place when the rotary shield is opened.

5. The bi-functional headlamp of claim 1, wherein the actuator includes:

a motor configured to generate rotational power to move the rotary shield;

a shield pulley configured to simultaneously rotate with the rotating shaft of the rotary shield;

a motor pulley configured to rotate by power of the motor; and a power transmission member coupled to the shield pulley and the motor pulley to be rotated simultaneously with the shield pulley and the motor pulley, and configured to transmit power of the motor to the rotary shield.

* * * * *